US005762532A

United States Patent [19]

Ishizuka et al.

[11] Patent Number: 5,762,532

[45] Date of Patent: Jun. 9, 1998

[54] RADIO CONTROLLED ENGINE MECHANISM PROVIDED IN A TOY VEHICLE

[75] Inventors: Shoji Ishizuka; Munetoshi Miyasaka, both of Tokyo, Japan

[73] Assignee: Nikko Co., Ltd., Tokyo, Japan

[21] Appl. No.: 663,715

[22] Filed: Jun. 14, 1996

[30] Foreign Application Priority Data

Jun. 14, 1995 [JP] Japan ..... 7-147711

[51] Int. Cl.[6] ..... A63H 30/04

[52] U.S. Cl. ..... 446/457; 446/456

[58] Field of Search ..... 446/454, 456, 446/457, 455

[56] References Cited

U.S. PATENT DOCUMENTS

| | | | |
|---|---|---|---|
| 2,679,712 | 6/1954 | Schwien et al. | 446/454 |
| 3,314,189 | 4/1967 | Carroll | 446/454 |
| 3,386,406 | 6/1968 | Tsunoda | 446/456 |
| 3,553,886 | 1/1971 | Hamilton | 446/456 |
| 3,683,546 | 8/1972 | Congdon | 446/456 |
| 3,705,387 | 12/1972 | Stern et al. | 446/460 |
| 4,301,617 | 11/1981 | Shaw | 446/457 |

*Primary Examiner*—Robert A. Hafer
*Assistant Examiner*—Jeffrey D. Carlson
*Attorney, Agent, or Firm*—Young & Thompson

[57] ABSTRACT

A radio controlled toy vehicle having a radio-controllable engine which starts by a motor and is capable of moving the toy vehicle in forward and reverse direction under the control of a servo mechanism, wherein the toy vehicle travels in a forward direction by use of driving power generated by the engine and travels in a reverse direction by use of driving power generated by the motor.

3 Claims, 8 Drawing Sheets

RADIO CONTROLLED ENGINE MECHANISM PROVIDED IN A TOY VEHICLE

BACKGROUND OF THE INVENTION

The present invention relates to a radio controlled toy vehicle, and more particularly to a radio controlled engine mechanism provided in a toy vehicle which travels in forward and reverse directions.

In the prior art, it is possible to use not only a motor but also an engine for driving a radio controlled toy vehicle. It can be generally said that engines can provide a larger driving force than motors. The rotation direction of the motor may easily be changed, whilst it is difficult to change in rotation direction of the engine. This means that if the motor is used then it is easy to change the direction of traveling of the toy vehicle by changing the rotation direction of the motor, whilst if the engine is used then it is difficult to change the direction of traveling of the toy vehicle because the engine rotates in one direction.

The use of engine for driving the toy vehicle renders traveling performance more attractive and more powerful, but raises the following problems.

First, the engine is normally designed to rotate in one direction, namely is unable to change its rotation direction. This means that if the engine is used, which is designed to rotate in one direction, then it is difficult to change the traveling direction of the vehicle provided with the engine due to the impossibility of changing the rotation direction of the engine.

Second, in the prior art, the engine accommodated in the radio controlled toy vehicle is normally started by hand power. This means that when the engine is started, the user has to start the engine by his or her hand power. Actually, the engine often stops when the toy vehicle hits an obstacle. In this case, it is necessary to restart the engine by hand power. It is therefore required to develop a novel engine mechanism which may be started under radio control and may change the traveling direction of the vehicle under radio control.

SUMMARY OF THE INVENTION

Accordingly, it is an object of the present invention to provide a novel radio controlled engine mechanism accommodated in a radio controlled toy vehicle, which is free from the problems as described above.

It is a further object of the present invention to provide a novel radio controlled engine mechanism accommodated in a radio controlled toy vehicle and started under radio control.

It is a further object of the present invention to provide a novel radio controlled engine mechanism accommodated in a radio controlled toy vehicle and being capable of changing the traveling direction of the radio controlled toy vehicle under radio control.

The present invention provides an engine driving mechanism provided in a toy vehicle, comprising the following elements. At least an engine is provided to generate a first driving power for an action of a toy vehicle. A first driving power transmission system is provided to be engaged between the engine and a first rotary shaft for transmitting the driving power to the first rotary shaft. At least a motor is provided, which is capable of rotations in first and second directions at a second driving power. A second driving power transmission system is provided to be engaged between the engine and the motor for transmitting the second driving power generated by the motor to the engine. A first gear is provided to be engaged with the second driving power transmission system for a rotation by the second driving power. A universal joint is provided, which has a first end engaged with a center of the first gear for a rotation around a longitudinal axis thereof in association with the rotation of the first gear. A first shaft is provided, which has a first end engaged with a second end of the universal joint for a rotation around a longitudinal axis thereof in association with the rotation of the universal joint. A second shaft is provided, which has a first end mechanically connected via a connection pin to a second end of the first shaft for a rotation around a longitudinal axis thereof free from the rotation of the first shaft. A spring member is provided in contact with a second end of the second shaft for pressing the second shaft toward the first shaft. A first one way clutch is provided, which is capable of engagement with both the first and second shafts. A rotation force transmission system is provided, which is engaged between the first clutch and the first driving power transmission system. A servo mechanism is provided, which has a servo horn being capable of rotations around a center thereof in first and second directions. A first arm is provided, which has a first end pivotaly engaged with the servo horn at a first point apart from the center of the servo horn and a second end connected with a first lever being capable of pushing the first shaft toward the second shaft. If the first arm moves toward the servo horn by a rotation of the servo horn, then not only the second shaft but also the first shaft enter into and are engaged with the first clutch whereby the second driving power of the motor is transmitted to the first driving power transmission system. If, however, the first arm moves toward the first shaft, then only the second shaft enters into and is engaged with the first clutch whilst the first shaft is not engaged with the first clutch whereby the second driving power of the motor is transmitted to the first shaft but not transmitted to the first driving power transmission system. A second arm is provided, which has a first end being pivotaly engaged with the servo horn at a second point apart from the center of the servo horn and a second end connected with a second lever. A third arm is provided, which has a first end being pivotaly engaged with the second lever and a second end connected with a throttle of the engine. If the servo horn rotates to have the first arm move toward the servo horn, then the third arm moves toward the second lever whereby the throttle is closed to place the engine in an idling state. If the servo horn rotates to have the first arm move toward the second lever, then the third arm moves toward the engine whereby the throttle is opened to place the engine in a powered state.

The second driving power transmission system may have a one-way clutch which transmits the second driving power of the motor into the engine when the motor rotates a rotary shaft of the engine in the forward direction, but prevent a transmission of the second driving power to the engine when the motor rotates a rotary shaft of the engine in the reverse direction.

The first driving power transmission system may comprise a first gear mechanism engaged with the engine and provided with a rotary disk which rotates in association with rotations of gears constituting the first gear mechanism, a second gear mechanism engaged with the first gear mechanism, a pair of brake pads sandwiching the rotary disk, a cam pivotally provided to push one of the brake pads toward an counterpart thereof, and a fourth arm being pivotally connected between the cam and the second lever which is connected with the second end of the first arm so that if the third arm moves toward the engine to close the throttle, then the cam pushes the brake pad whereby the rotary disk is sandwiched to suppress a rotation of the rotary disk.

BRIEF DESCRIPTIONS OF THE DRAWINGS

A preferred embodiment according to the present invention will be described in detail with reference to the accompanying drawings.

PREFERRED EMBODIMENTS

Figure 1:
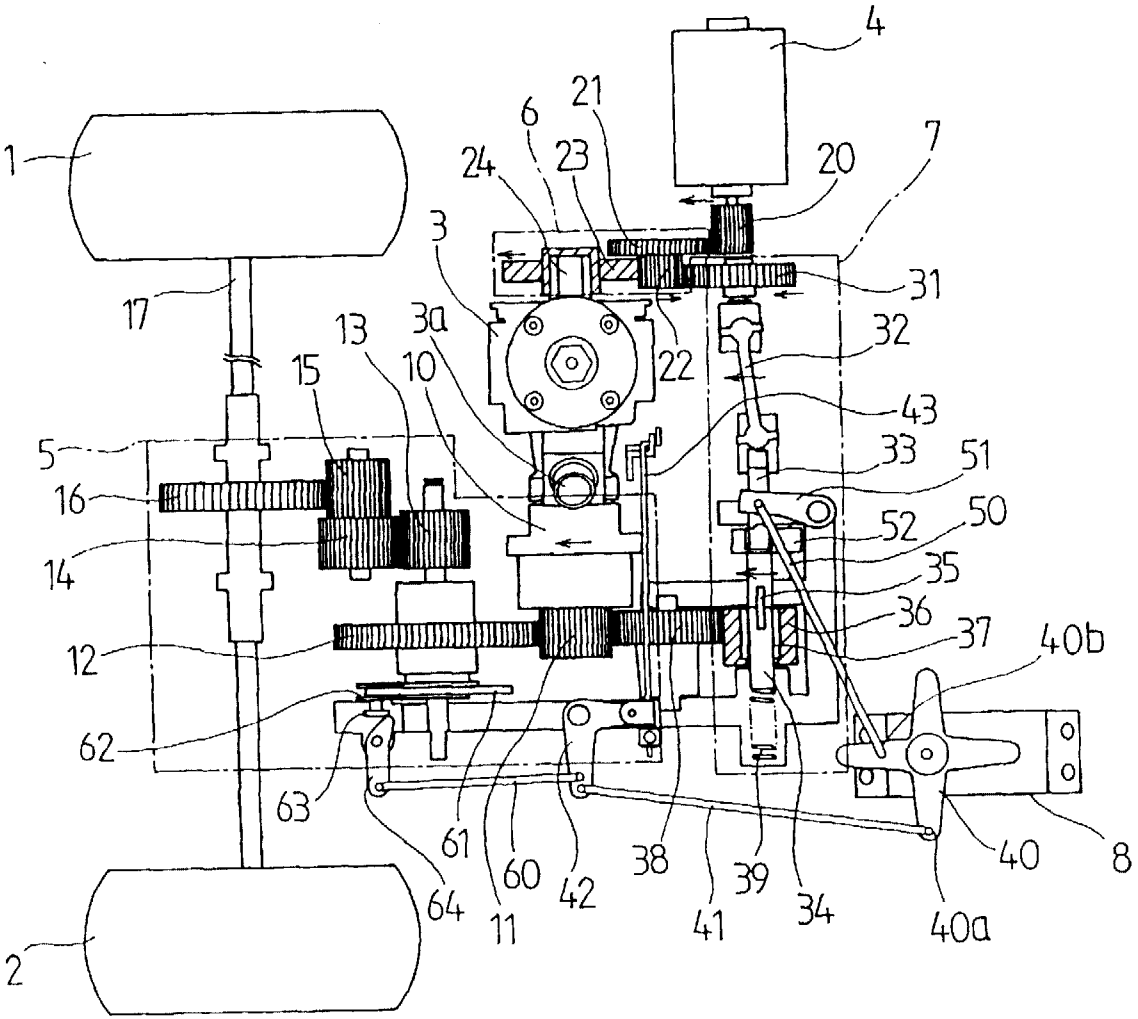
FIG. 1 is a plan view illustrative of a novel radio controlled engine mechanism to be accommodated in a radio controlled toy car when the engine is stopped in a preferred embodiment according to the present invention.

A preferred embodiment according to the present invention will be described, which provides a novel radio controlled engine mechanism to be accommodated in a radio controlled toy car.

The novel radio controlled engine mechanism is placed on a chassis and accommodated within a body of a radio controlled toy car. Rear tires 1 and 2 are mechanically connected via a rotary shaft 17 which is placed on the chassis. The novel radio controlled engine mechanism has an engine 3 for generating a driving power and transmits the driving power onto an engine rotary shaft. The novel radio controlled engine mechanism also has a first transmission system which is provided between the engine 3 and the rotary shaft 17 connected to the rear tires 1 and 2 for transmitting the driving power to the rotary shaft 17. Front tires are not illustrated in FIG. 1. The novel radio controlled engine mechanism also has a motor 4 connected with a rotary shaft and generating a rotation force. The novel radio controlled engine mechanism also has a second transmission system 6 provided between the engine 3 and the motor 4 for transmitting the rotation force generated by the motor onto the rotary shaft 10 of the engine 3 in order to start the engine 3. The novel radio controlled engine mechanism also has a third transmission system 7 provided between the motor 4 and the first transmission system 5 for transmitting the rotation force generated by the motor 4 to the first transmission system 5 whereby the rotation direction of the rotary shaft 17 connected to the rear tires 1 and 2 is changed whilst the rotation direction of the rotary shaft 10 of the engine 3 remains unchanged. The novel radio controlled engine mechanism also has a servo mechanism 8 connected to both the first and third transmission systems 5 and 7 for controlling the driving power of the engine 3.

The first transmission system 5 comprises the following elements. A first gear 11 is provided, which has a center portion being mechanically connected to the rotary shaft 10 of the engine 3. A second gear 12 is provided, which is engaged with the first gear 11 and has a center portion mechanically fixed with a rotary shaft. The second gear 12 is larger in diameter than the first gear 11. The second gear 12 rotates in an opposite direction to the first gear 11. A third gear 13 is provided on the rotary shaft of the second gear 12. The third gear 13 is smaller in diameter than the second gear 11. The third gear 13 rotates the same direction as the second gear 12. A fourth gear 14 is provided, which is engaged with the third gear 13 and has a center portion mechanically fixed with a rotary shaft. The fourth gear 14 is slightly larger in diameter than the third gear 13. The fourth gear 14 rotates in an opposite direction to the third gear 13. A fifth gear 15 is provided on the rotary shaft of the fourth gear 14. The fifth gear 15 is slightly smaller in diameter than the fourth gear 14. The fifth gear 15 rotates the same direction as the fourth gear 14. A sixth gear 16 is provided, which is engaged with the fifth gear 15 and has a center portion mechanically fixed with the rotary shaft 17 of the rear tiers 1 and 2. The sixth gear 16 is larger in diameter than the fifth gear 15. The sixth gear 16 rotates in an opposite direction to the fifth gear 15 and also opposite to the first gear 11. The driving power generated by the engine 3 is therefore transmitted to the rotary shaft 17 connected to the rear tires 1 and 2 through the above first to sixth gears 11–16.

The above second transmission system 6 between the motor 4 and the engine 3 comprises the following elements. A seventh gear 20 is provided on the rotary shaft of the motor 4. An eighth gear 21 is provided, which is engaged with the seventh gear 20 and has a center portion mechanically fixed with a rotary shaft. The eighth gear 21 is larger in diameter than the seventh gear 20. The eighth gear 21 rotates in an opposite direction to the seventh gear 20 which rotates the same direction as the rotary shaft of the motor 4. A ninth gear 22 is provided on the rotary shaft of the eighth gear 21. The ninth gear 22 is smaller in diameter than the eighth gear 21. The ninth gear 22 rotates the same direction as the eighth gear 21. A tenth gear 23 is provided, which is engaged with the ninth gear 22 and has a center portion mechanically connected with a first one way clutch 24 which has a rotation axis mechanically fixed with the rotary shaft 10 of the engine 3. The tenth gear 23 is larger in diameter than the ninth gear 22. The tenth gear 23 rotates in an opposite direction to the ninth gear 22. Namely, the tenth gear 23 mechanically connected with the first one way clutch 24 rotates in the same direction as the seventh gear 20 or the rotary shaft of the motor 4. The first one way clutch 24 is designed to transmit the rotation of the tenth gear 23 to the rotary shaft 10 of the engine 3 but not to transmit the rotation of the rotary shaft 10 of the engine 3 to the tenth gear 23. Namely, the first one way clutch 24 allows the rotation force generated by the motor 4 to be transmitted to the rotary shaft of the engine 3 but prevents the driving power generated by the engine 3 from being transmitted to the motor 4.

The third transmission system 7 provided between the motor 4 and the first transmission system 5 comprises the following elements. An eleventh gear 31 is provided, which is engaged with the ninth gear 22 of the second transmission system 6. The eleventh gear 31 is larger in diameter than the ninth gear 22 and rotates in an opposite direction to the ninth gear 22. Namely, the eleventh gear 31 rotates in the same direction as the seventh gear 20 or the rotary shaft of the motor 4. The eleventh gear 31 has a center portion mechanically fixed with a rotary shaft. A universal joint 32 is provided which has a first end being mechanically connected with the rotary shaft connected with the center portion of the eleventh gear 31. The universal joint 32 rotates in the same direction as the eleventh gear 31. A first back shaft 33 is provided, which has a first end mechanically connected with a second end of the universal joint 32. The first back shaft 33 rotates in the same direction as the universal joint 32 or the eleventh gear 31. A second back shaft 34 is provided, which has a first end mechanically connected via a connection pin 35 to a second end of the first back shaft 33. The second back shaft 34 is free from the rotation of the first back shaft 33. The second back shaft 34 has a second end which is in contact with a spring member 39 sandwiched between a fixed wall and the second end of the second back shaft 34 whereby the second back shaft 34 is pressed by the spring member 39 toward the first back shaft 33. As a result, the first back shaft 33 is also pressed by the second back shaft 34 toward the universal joint 32. The universal joint 32 is also pressed by the first back shaft 33 toward the eleventh gear 31. A twelfth gear 36 is provided on the second back shaft 34. The twelfth gear 36 has an inner space within which a second one way clutch 37 is accommodated. The second one way clutch 37 is in contact directly with the second back shaft 34 and thus the twelfth gear 36 is mechanically connected via the second one way clutch 37 to the second back shaft 34. A thirteenth gear 38 is provided, which is engaged not only at its one end with the twelfth gear 36 but also at a diametrically opposite end with the first gear 11 of the first transmission system 5. The thirteenth gear 38 is larger in diameter than the twelfth gear 36 and the first gear 11. The thirteenth gear 38 rotates in an opposite direction to the first and the thirteenth gears 11 and 38. If the first gear 11 is mechanically connected to the twelfth gear 36 via the thirteenth gear 38, then the first gear 11 rotates in the same direction as the thirteenth gear 38. As described above, the above first and second back shafts 33 and 34 are connected with each other via the connection pin 35 so that the first and second back shafts 33 and 34 may rotate independently from one another. The second one way clutch 37 allows the rotation force of the second back shaft 34 to be transmitted to the twelfth gear 36 engaged with the thirteenth gear 38, but prevents the rotation force of the twelfth gear 36 from being transmitted to the second back shaft 34. Namely, the second one way clutch 37 is designed to allow the rotation force generated by the motor 4 to be transmitted to first transmission system 5 but prevent the driving power generated by the engine 3 from being transmitted to the motor 4.

The output of the engine 3 is controllable by the servo mechanism 8. The servo mechanism 8 is provided with a servo horn 40 which is cross-shaped to have four arms 40*a*, 40*b*, 40*c* and 40*d* radially extending from its center portion. The end of the first arm 40*a* of the servo horn 40 provided on the servo mechanism 8 is pivotally connected with one end of a first operation shaft 41 which also has an opposite end pivotally connected with a first arm of an L-shaped crank 42 which is pivotally provided in the first transmission system 5 on the chassis of the toy car. A second operation shaft 43 is further provided, which has a first end connected with a second arm of the L-shaped crank 42 so that the second operation shaft 43 is mechanically connected to the first operation shaft 41 via the L-shaped crank 42. The second operation shaft 43 extends toward the engine 3 so that a second end of the second operation shaft 43 is mechanically connected to the engine 3. When the servo mechanism 8 is driven to cause a rotation of the servo horn 40 whereby the first operation shaft 41 almost reciprocally moves. This movement of the first operation shaft 41 causes the rotation of the L-shaped crank 42 whereby the second operation shaft 43 almost reciprocally moves to cause alternating operations of opening and closing a slot of the engine 3. Since the size of the opening of the slot of the engine 3 substantially determines an amount of fuel injection from a carburetor 3*a*, the revolution speed of the engine 3 varies to depend upon the degree in opening of the slot of the engine 3. Further, a third operation shaft 50 is provided, which has a first end mechanically connected with the second arm 40*b* of the servo horn 40. In the third transmission system 7, a back lever horn 51 is provided, which has a first end being pivotally mounted on the chassis of the toy car. A second end of the third operation shaft 50 is mechanically connected with a second end of the back lever horn 51. A back lever 52 is fixed on the first back shaft 33. When the servo mechanism 8 is driven and the servo horn 40 rotates so that the third operation shaft 50 shows almost reciprocal motion whereby the second end of the back lever horn 51 moves almost along the longitudinal direction of the first back shaft 33. If the third operation shaft 50 moves toward the servo horn 40, then the second end of the back lever horn 51 presses the back lever 52 fixed on the first back shaft 33. As a result, the first and second back shafts 33 and 34 move toward the spring member 39 so that the not only the second back shaft 34 but also the first back shaft 33 come engaged with the second one way clutch 37. The engagement of the first back shaft 33 with the second one way clutch 37 causes the rotation force of the first back shaft 33 to be transmitted via the twelfth gear 36 and the thirteenth gear 38 to the first transmission system 5.

Moreover, in the first transmission system 5, a rotary disk 61 is provided, which is mechanically fixed with the rotary shaft of the second gear 12. A pair of brake pads 62 is provided, which sandwiches the rotary disk 61. The brake pad positioned at outside is provided with a convex portion 63. A brake cam 64 is pivotally provided, which has a first end in contact with the convex portion 63. A fourth operation shaft 60 is provided, which has a first end mechanically connected with the first arm of the L-shaped crank 42 and a second end mechanically connected with a second end of the brake cam 64. Thus, the second end of the brake cam 64 is mechanically connected via the fourth operation shaft 60 to the first arm of the L-shaped crank 42 which is further mechanically connected via the first operation shaft 41 to the first arm 40*a* of the servo horn 40. Consequently, the second end of the brake cam 64 is mechanically connected to the servo horn 40 pivotally provided on the servo mechanism 8. When the first arm 40*a* of the servo horn 40 comes distant from the brake pads 62, then the first and fourth operation shafts 41 and 60 move toward the servo horn 40 whereby the first end of the brake cam 64 pushes the convex portion 63 toward the rotary disk 61. As a result, the brake pads 62 sandwiches the rotary disk 61 to suppress the rotation of the rotary disk 61 fixed on the rotary shaft of the second gear 12.

Figure 5:
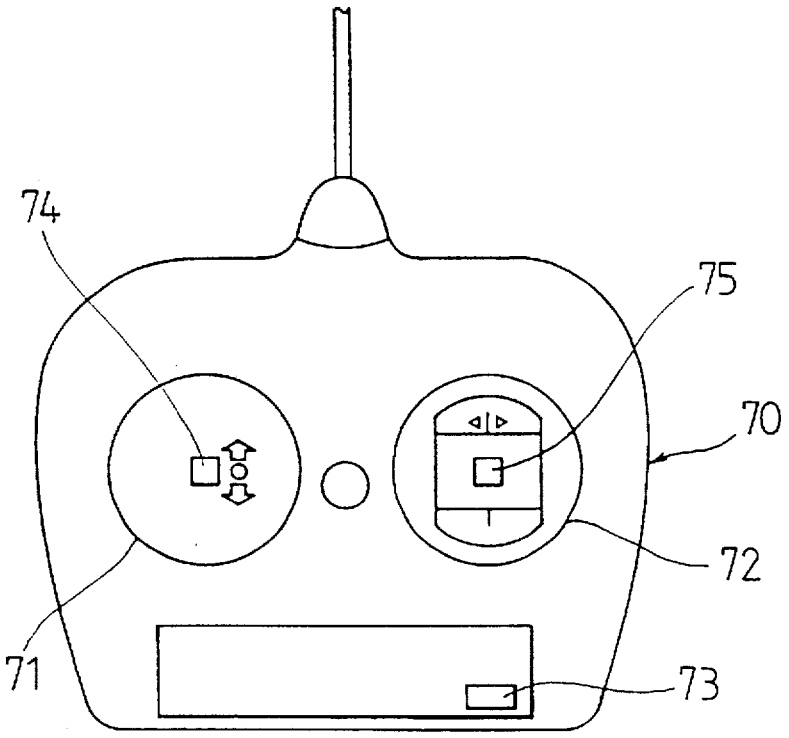
FIG. 5 is a front view illustrative of a radio control signal transmitter to be used for sending radio control signals to a radio control toy car.

With reference to FIG. 5, a radio control signal transmitter 70 includes a forward/reverse switching section 71, a right-turn/left-turn switching section 71 and a starter switching section having a starter switch button 73. The forward/reverse switching section 71 has a forward/reverse switching lever 74 movable in the vertical direction. The right-turn/left-turn switching section 71 has a right-turn/left-turn switching lever 75 movable in the horizontal direction.

Figure 6:
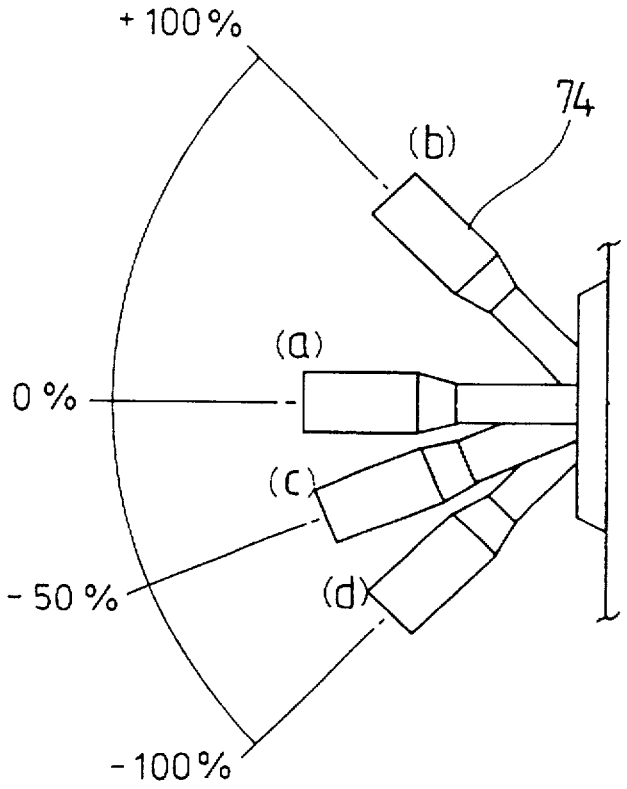
FIG. 6 is a view illustrative of operations of a radio control signal transmitter to be used for sending radio control signals to a radio control toy car in a preferred embodiment according to the present invention.

With reference to FIG. 6, the position of the forward/reverse switching lever 74 determines the output of the engine and the forward/reverse traveling direction.

Figure 7:
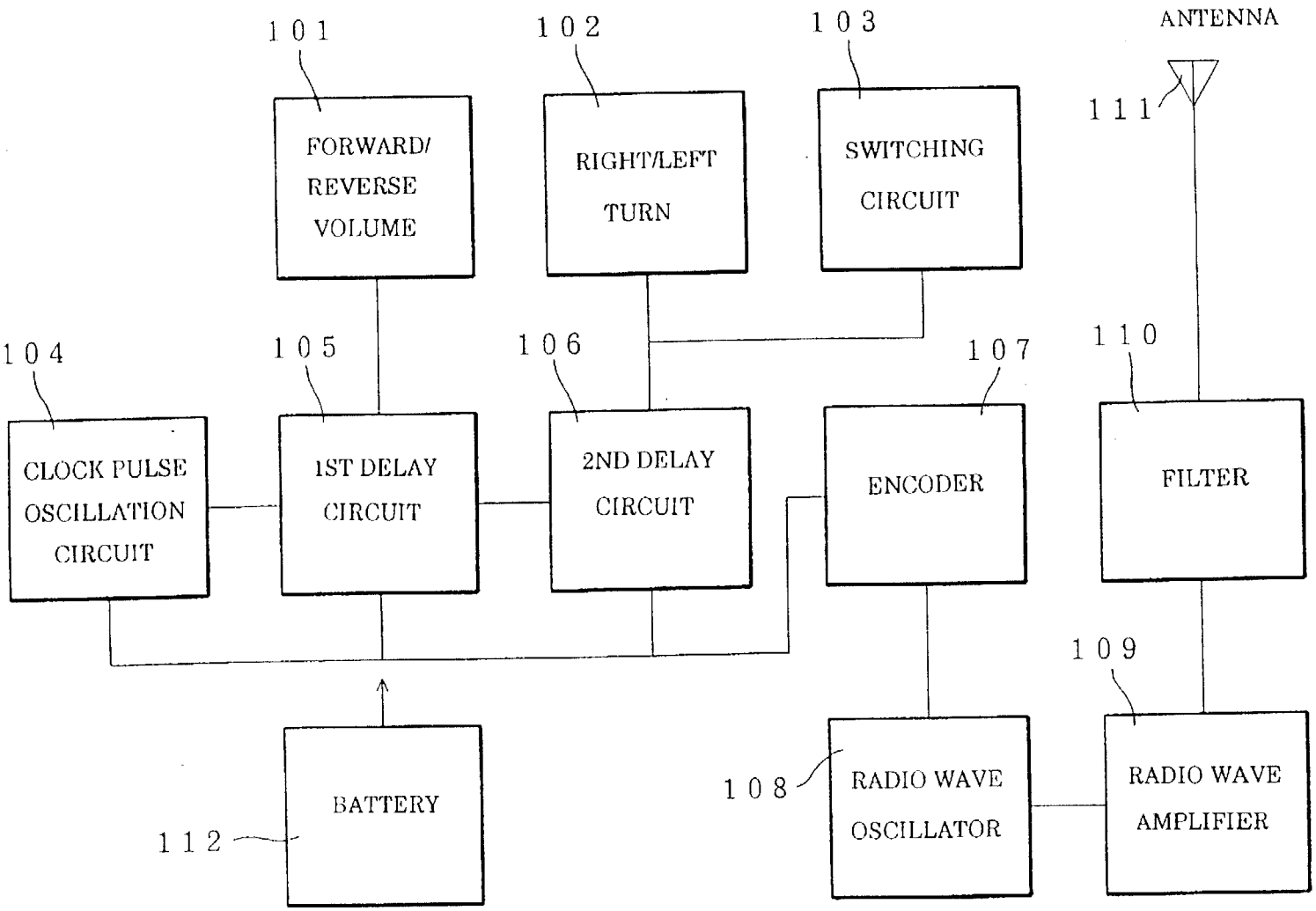
FIG. 7 is a block diagram illustrative of internal circuits in a radio control signal transmitter to be used for sending radio control signals to a radio control toy car in a preferred embodiment according to the present invention.

Internal circuit configurations of the radio control signal transmitter 70 to be used in this preferred embodiment are illustrated in FIG. 7. The internal circuit configurations of the radio control signal transmitter 70 are supplied with power by a battery 112. The internal circuit configurations of the radio control signal transmitter 70 have a clock pulse oscillator which generates lock pulse signals with a pulse width determined by the level of power supplied by the battery. The internal circuit configurations of the radio control signal transmitter 70 have a forward/reverse volume 101 in association with the operation of the forward/reverse switching lever 74. The forward/reverse volume 101 supplies forward/reverse control signals, in accordance with which the engine 3 operates and a toy car travels in a certain forward or reverse direction. The internal circuit configurations of the radio control signal transmitter 70 have a right-turn/left-turn volume 102 in association with the operation of the right-turn/left-turn switching lever 75. The right-turn/left-turn volume 102 supplies right-turn/left-turn signals in accordance with which the toy car will turn right or turn left. The internal circuit configurations of the radio control signal transmitter 70 also have an engine starter switching circuit 103 in association with the operation of the starter switch button 73. The engine starter switching circuit 103 supplies an engine starting signal in accordance with which the engine 3 will be started. A first delay circuit 105 is provided which is electrically connected to the forward/reverse volume 101 and the clock pulse oscillator 104. A second delay circuit 106 is provided, which is electrically connected to the right-turn/left-turn volume 102 and the clock pulse oscillator 104 in addition connected to the engine starter switching circuit 103. The forward/reverse control pulse signals generated by the forward/reverse volume 101 are delayed by the first delay circuit 105 and the right-turn/left-turn control pulse signals generated by the right-turn/left-turn volume 102 are delayed by the second delay circuit 106. The engine starting pulse signal generated by the starting switch circuit 103 is also delayed by the second delay circuit 106. An encoder circuit 107 is provided, which is connected to the first and second delay circuits 105 and 106 and the clock pulse oscillation circuit 104 for encoding the forward/reverse control pulse signals and the right-turn/left-turn control pulse signals as well as engine starting pulse signal. A radio wave oscillator 108 is provided, which is connected to the encoder 107 for fetching the encoded forward/reverse control signals and the right-turn/left-turn control pulse signals as well as engine starting pulse signal to thereby output the radio control signal. A radio wave amplifier 109 is also provided, which is electrically connected to the radio wave oscillator 108 for fetching the radio control signal to amplify the same. A filter 110 is provided, which is connected to the radio wave amplifier 109 for fetching the amplified radio control signal from the radio wave amplifier 109 and filtering the same. The filtered radio control signal is transmitted via an antenna 111 from the radio control signal transmitter 70.

Figure 8:
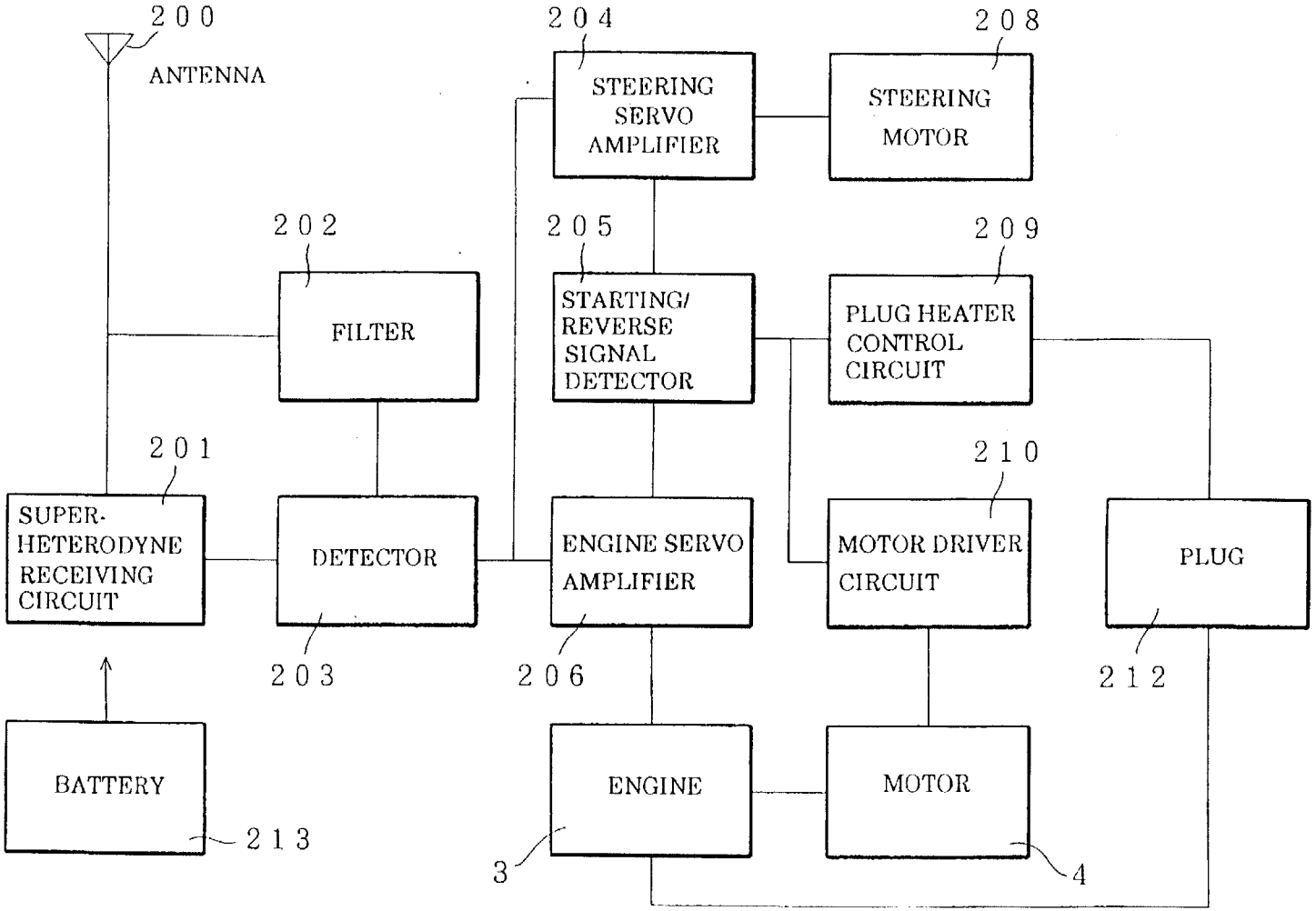
FIG. 8 is a block diagram illustrative of how to control every elements constituting a novel radio controlled engine mechanism to be accommodated in a radio controlled toy car in a preferred embodiment according to the present invention.

The toy car accommodating the engine mechanism described above is further provided with a control section for controlling the engine mechanism. The control section has circuit configurations as illustrated in FIG. 8. The control section is supplied with power by a battery 213. The control section has an antenna 200 which receives the radio control signals having been transmitted from the radio control signal transmitter 70. The control section also has a super heterodyne receiving circuit 201 which is electrically connected to the antenna 200 for fetching the radio control signals from the antenna 200. The control section also has a filter 202 which is electrically connected to the antenna 200 for fetching the radio control signals from the antenna 200 and filtering the same. The control section also has a detector 203 which is electrically connected to both the filter 202 and the super heterodyne receiving circuit 201 for fetching the radio control signal from the super heterodyne receiving circuit 201 and the filtered radio control signal from the filter 202 to thereby detect a predetermined signal from the fetch radio control signals. The control section also has a steering servo amplifier 204 which is electrically connected to the detector 203 for fetching the detected signal and amplifying the same. A steering motor 208 is electrically connected to the steering servo amplifier 204 for fetching the amplified signal and controlling the driving operation of the steering motor 208 which is driven in accordance with the amplified signal. The control section also has an engine servo amplifier 206, which is electrically connected to the detector 203 for fetching the amplified signal and amplifying the same. The engine servo amplifier 206 is further electrically connected to the engine 3 for feeding the amplified signal to the servo mechanism 8 illustrated in FIG. 1 so as to drive the servo mechanism 8 and cause the rotation of the servo horn 40, whereby the output of the engine 3 is controlled via the servo mechanism 8 which is under the control in accordance with the amplified signal from the engine servo amplifier 206. The control section also has a start/reverse signal detector 205, which is electrically connected to both the steering servo amplifier 204 and the engine servo amplifier 206 for fetching the signal amplified detection signal to detect any start/reverse signal from the fetched signal. The control section also has a plug heater control circuit 209 which is electrically connected to the start/reverse signal detector 205 for fetching the detected start/reverse signal from the start/reverse signal detector 205 and also connected to an engine plug 212 of the engine 3 for firing the engine plug 212 in accordance with the start signal fetched from the start/reverse signal detector 205. The control section also has a motor driving circuit 210 which is electrically connected to the start/reverse signal detector 205 for fetching the detected start/reverse signal from the start/reverse signal detector 205 and also connected to the motor 4 for driving the same in accordance with the start signal fetched from the start/reverse signal detector 205 whereby the engine 3 is started by the driving force of the motor 4. The motor driving circuit 210 also drives the engine 3 in a reverse direction in accordance with the reverse signal fetched from the start/reverse signal detector 205.

The following descriptions will focus on the operations of the above engine mechanism radio-controllable.

In order to start the engine 3, the radio control signal transmitter 70 is operated to have the forward/reverse switching section 71 positioned horizontally as illustrated in FIG. 6 (*a*). In the meantime, the starter switch button 73 illustrated in FIG. 5 is pushed to cause the starter switching circuit 103 driven thereby resulting in no output signal from the right-turn/left-turn volume 102. As a result, only the output signal from the forward/reverse volume 101 is transmitted through the first delay circuit 105, the encoder circuit 107, the radio wave oscillator 108, the radio wave amplifier 109, the filter 110 and the antenna 111 to the antenna of the control section for controlling the engine mechanism. The signal is then transmitted to the start/reverse signal detector 205 where the start/reverse signal is detected. The detected start/reverse signal is then transmitted into the plug heater control circuit 209. In the meantime, the start/reverse signal is transmitted into the motor driving circuit 210. As a result, the plug is fired by the plug heater control circuit 209 and concurrently the motor 4 causes the rotation of the rotary shaft of the engine 3 whereby the engine 3 starts.

In starting the engine 3, the engine mechanism operates as follows. At the same time when the plug is fired by the plug heater control circuit 209, the motor 4 commences to rotate whereby the seventh, eighth, ninth and tenth gears 20, 21, 22 and 23 are caused to rotate. This rotation force is transmitted via the first one way clutch 24 to the rotary shaft of the engine whereby the engine 3 starts. On the other hand, in the third transmission system 7, the servo horn 40 provided on the servo mechanism 8 is positioned as illustrated in FIG. 1 so that only the second back shaft 34 enters into and is engaged with the second one way clutch 37. The rotation of the rotary shaft of the motor 4 is transmitted through the seventh, eighth, ninth and eleventh gears 20, 21, 22 and 31 and the universal joint 32 to the first back shaft 33. Since, however, the second back shaft 34 is free from the rotation of the first back shaft 33 and as described above the first back shaft is not engaged with the second one way clutch 37, the rotation force having transmitted from the motor 4 is not transmitted to the second one way clutch 37. As a result, the rotation force having been transmitted from the motor 4 is not transmitted to the first transmission system 5 and the rear tires 1 and 2. As a result, the engine has started but the rear tires 1 and 2 remain inaction.

Figure 2:
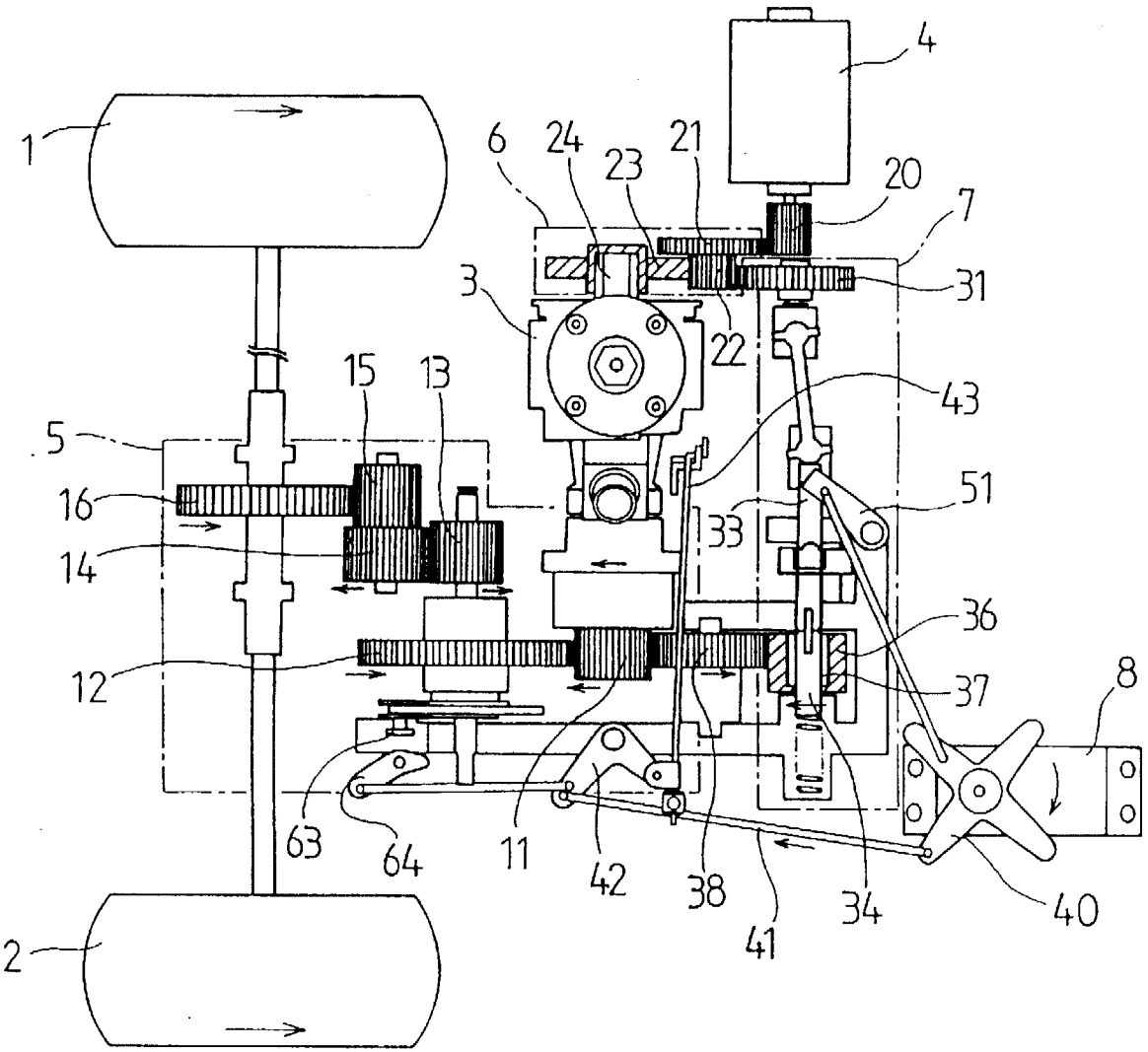
FIG. 2 is a plan view illustrative of a novel radio controlled engine mechanism to be accommodated in a radio controlled toy car when the toy car travels in a forward direction in a preferred embodiment according to the present invention.

After the engine 3 has started, the radio control signal transmitter 70 is operated to have the forward/reverse switching section 71 positioned upwardly as illustrated in FIG. 6 (*b*) whereby the forward signal is transmitted from the radio control signal transmitter 70 to the control section of the engine mechanism. The forward signal is then transmitted via the detector 203 to the engine servo amplifier 206 before the servo horn 40 on the servo mechanism 8 rotates in a clockwise direction so as to be positioned as illustrated in FIG. 2. The first and second operation shafts 41 and 43 move to have the throttle full open and take the engine 3 to full power. The full driving power of the engine 3 is transmitted through the first transmission system 5 to the rotary shaft of the rear tiers 1 and 2 whereby the toy car travels in the forward direction. On the other hands, the servo horn 40 moves the third operation shaft so that the first and second back shafts 33 and 34 move toward the universal joint 32. As a result, only the second back shaft 34 enters into or is engaged with the second one way clutch 37 and the first back shaft 33 is not engaged with the second one way clutch 37. The driving power of the engine 3 showing full power is also transmitted through the first gear 11, the thirteenth gear 38, the twelfth gear 36 and the second one way clutch 37 to the second back shaft 34. Since, however, as described above the first back shaft 33 is not engaged with the second one way clutch 37 and the first back shaft 33 is free from the rotation of the second back shaft 34, the driving power of the engine 3 is not transmitted to the first back shaft 33. Namely, the driving power of the engine 3 is not transmitted to the motor 4.

Figure 3:
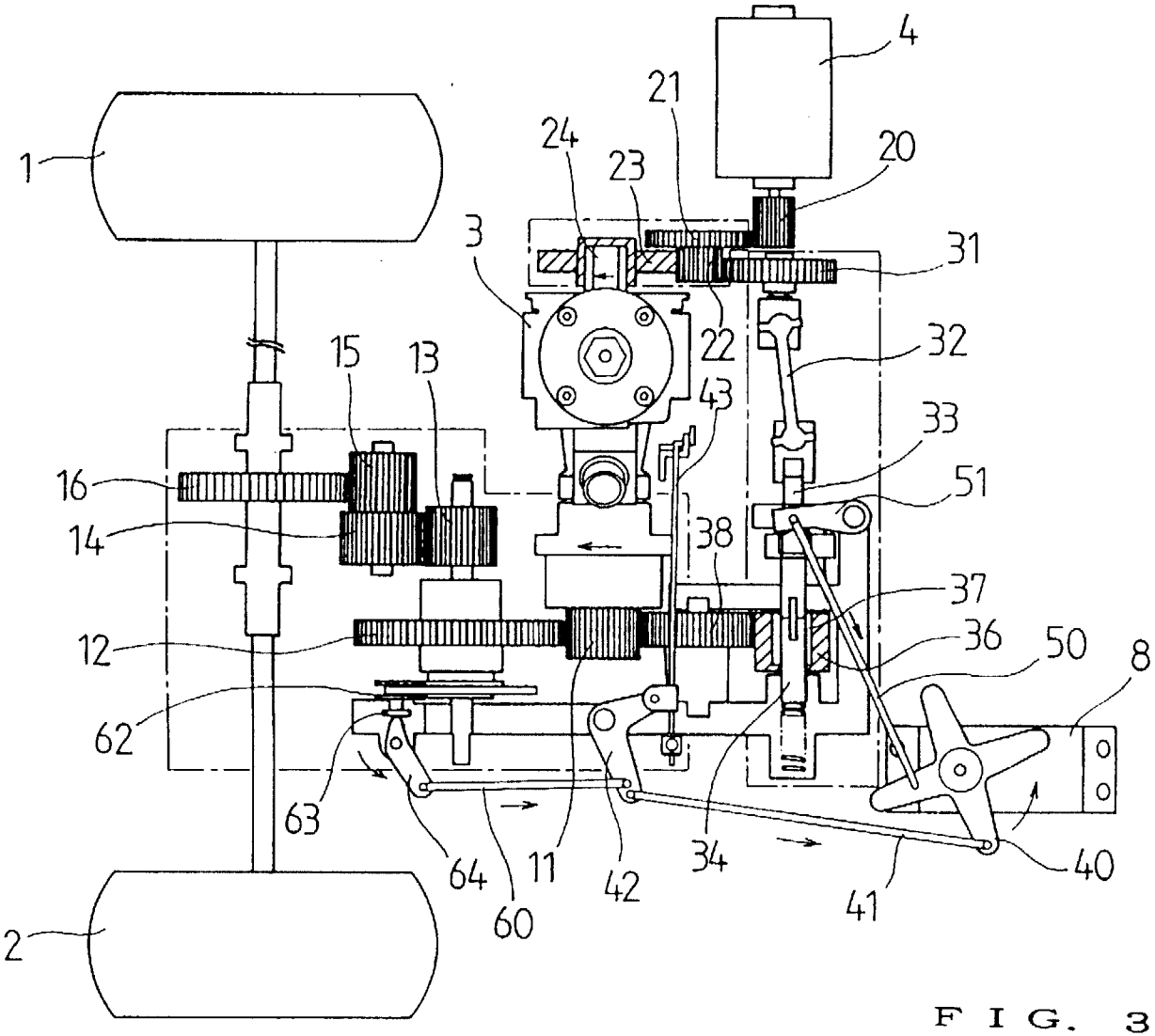
FIG. 3 is a plan view illustrative of a novel radio controlled engine mechanism to be accommodated in a radio controlled toy car immediately before a back-motor will be started in a preferred embodiment according to the present invention.
Figure 4:
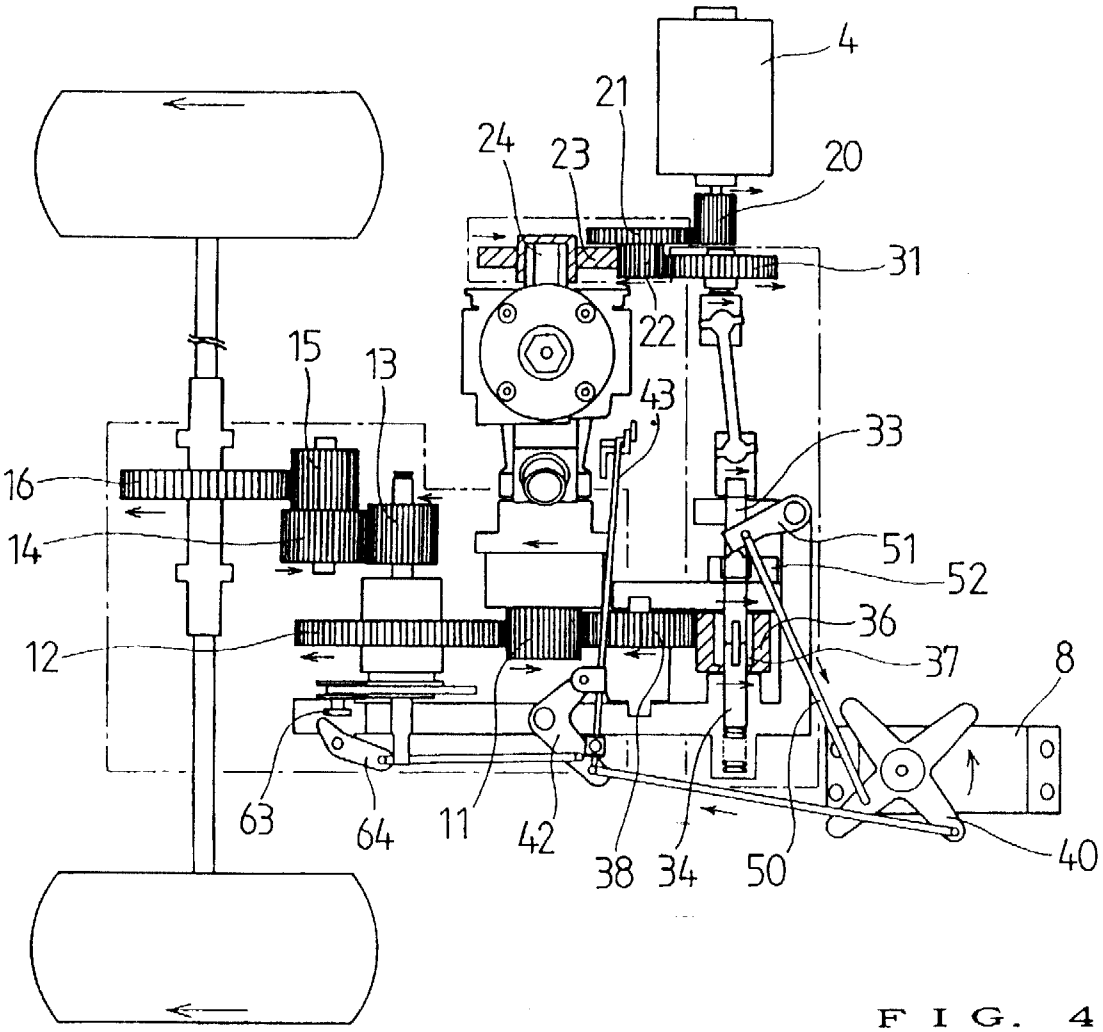
FIG. 4 is a plan view illustrative of a novel radio controlled engine mechanism to be accommodated in a radio controlled toy car when the toy car travels in a reverse direction in a preferred embodiment according to the present invention.

If it is required to have the toy car travel in the reverse direction, the radio control signal transmitter 70 is operated to have the forward/reverse switching section 71 positioned downwardly as illustrated in FIG. 6 (*c*) whereby the reverse signal is transmitted from the radio control signal transmitter 70 to the control section of the engine mechanism. The reverse signal is then transmitted to the engine servo amplifier 206 whereby the engine servo amplifier 206 drives the servo horn 40. The servo horn 40 rotates in the anticlockwise direction and then comes positioned as illustrated in FIG. 3. The first operation shaft 41 moves toward the servo horn 40 and the second operation shaft 43 moves toward the engine 3 thereby the throttle of the engine 3 is closed. As a result, the engine 3 enters into the idling state. On the other hand, the fourth operation shaft moves toward the servo horn 40 whereby the brake cam 64 pushes the convex portion 63 of the brake pad 62 so that the paired brake pads 62 sandwich the rotary disk 61 to suppress the rotation of the rotary disk 61 to control the traveling in the forward direction of the toy car. Further, the third operation shaft 50 moves toward the servo horn 40 whereby the back level horn 51 rotates to push the back level 52. As a result, the first and second back shafts 33 and 34 move toward the spring member 39 so that the first back shaft 33 slightly enters into the second one way clutch 37.

Subsequently, the radio control signal transmitter 70 is operated to have the forward/reverse switching section 71 positioned downwardly as illustrated in FIG. 6 (*d*) whereby the reverse signal still remains transmitted from the radio control signal transmitter 70 to the control section of the engine mechanism. The reverse signal is also transmitted via the engine servo amplifier 206 into the start/reverse signal detector 205. The reverse signal is then transmitted to the motor driving circuit 210. The servo horn 40 further rotates in the anticlockwise direction. The first operation shaft further moves toward the servo horn 40 and the fourth operation shaft 60 also moves toward the servo horn 40 whereby the brake cam 64 further rotates the until the brake cam 64 is detached from the convex portion 63 of the brake pad 62. The paired brake pads comes separated from the rotary disk 61 whereby the rotary disk 61 becomes able to freely rotate. Further, the third operation shaft moves toward the servo horn 40 whereby the back lever horn 51 further rotates and further pushes the back lever 52 toward the second back shaft 34 so that not only the second back shaft 34 but also the first back shaft 33 sufficiently enter into and are securely engaged with the second one way clutch 37. Since the second operation shaft remains in a position near that illustrated in FIG. 3 where the throttle is closed, the throttle remains closed and thus the engine 3 remains in the idling state. On the other hand, the rotation force generated by the motor 4 is transmitted to the first back shaft 33 securely engaged with the second one way clutch 37 whereby the rotation force is then transmitted through the twelfth gear 36 and the thirteenth gear 38 to the first transmission system 5. The rotation direction of the motor 4 has been set so that the rotary shaft connected with the rear tires 1 and 2 rotates in an opposite direction to when the driving power of the engine 3 has been transmitted to the rotary shaft connected with the rear tires 1 and 2. As a result, the toy car travels in the reverse direction.

The motor 4 starts to rotate a predetermined time interval, for example, three minutes after the back signal is inputted into the control section for controlling the engine mechanism so that during the time interval the rotation speed is reduced by the brake pads to thereby prevent any damage of the gear systems due to rapid change in the rotation direction.

When the toy car travels in the reverse direction, the motor 4 rotates in the opposite direction to that when the motor 4 causes the engine 3 to start. Since the one way clutch is provided between the rotary shaft of the engine 3 and the motor 4, the rotation force of the motor 4 in the reverse mode is not prevented by the one way clutch from being transmitted to the rotary shaft of the engine 3.

Needless to say, the above described novel radio-controllable engine mechanism is applicable to any other toys.

Whereas any modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. An engine driving mechanism provided in a toy vehicle, comprising:

at least an engine generating a first driving power for an action of a toy vehicle;

a first driving power transmission system engaged between said engine and a first rotary shaft for transmitting said driving power to said first rotary shaft;

at least a motor being capable of rotations in first and second directions at a second driving power;

a second driving power transmission system engaged between said engine and said motor for transmitting said second driving power generated by said motor to said engine;

a first gear engaged with said second driving power transmission system for a rotation by said second driving power and;

a universal joint having a first end being engaged with a center of said first gear for a rotation around a longitudinal axis thereof in association with said rotation of said first gear;

a first shaft having a first end engaged with a second end of said universal joint for a rotation around a longitudinal axis thereof in association with said rotation of said universal joint;

a second shaft having a first end mechanically connected via a connection pin to a second end of said first shaft for a rotation around a longitudinal axis thereof free from said rotation of said first shaft;

a pressing means in contact with a second end of said second shaft for pressing said second shaft toward said first shaft;

a first one way clutch being capable of engagement with both said first and second shafts;

a rotation force transmission system engaged between said first clutch and said first driving power transmission system;

a servo mechanism having a servo horn being capable of rotation around a center thereof in first and second directions;

a first arm having a first end being pivotally engaged with said servo horn at a first point apart from said center of said servo horn and a second end connected with a first lever being capable of pushing said first shaft toward said second shaft so that if said first arm moves toward said servo horn by a rotation of said servo horn, then not only said second shaft but also said first shaft enter into and are engaged with said first clutch whereby said second driving power of said motor is transmitted to said first driving power transmission system, and if said first arm moves toward said first shaft, then only said second shaft enters into and is engaged with said first clutch whilst said first shaft is not engaged with said first clutch whereby said second driving power of said motor is transmitted to said first shaft but not transmitted to said first driving power transmission system;

a second arm having a first end being pivotally engaged with said servo horn at a second point apart from said center of said servo horn and a second end connected with a second lever; and a third arm having a first end being pivotally engaged with said second lever and a second end connected with a throttle of said engine so that if said servo horn rotates to have said first arm move toward said servo horn, then said third arm moves toward said second lever whereby said throttle is closed to place said engine in an idling state, and if said servo horn rotates to have said first arm move toward said second lever, then said third arm moves toward said engine whereby said throttle is opened to place said engine in a powered state.

2. The engine driving mechanism as claimed in claim 1, wherein said second driving power transmission system has a one-way clutch which transmits said second driving power of said motor into said engine when said motor rotates a rotary shaft of said engine in said forward direction, but prevents a transmission of said second driving power to said engine when said motor rotates a rotary shaft of said engine in said reverse direction.

3. The engine driving mechanism as claimed in claim 1, wherein said first driving power transmission system comprises:

a first gear mechanism engaged with said engine and provided with a rotary disk which rotates in association with rotations of gears constituting said first gear mechanism;

a second gear mechanism engaged with said first gear mechanism;

a pair of brake pads sandwiching said rotary disk;

a cam pivotally provided to push one of said brake pads toward a counterpart thereof; and a fourth arm being pivotally connected between said cam and said second lever which is connected with said second end of said first arm so that if said third arm moves toward said engine to close said throttle, then said cam pushes said brake pad whereby said rotary disk is sandwiched to suppress a rotation of said rotary disk.

* * * * *